United States Patent [19]

Armiger

[11] 4,381,107

[45] Apr. 26, 1983

[54] CUTTING AND COLLATING METHOD AND APPARATUS FOR TICKETS

[75] Inventor: John W. Armiger, 4110 W. Puget Ave., Phoenix, Ariz. 85021

[73] Assignee: John W. Armiger, Phoenix, Ariz.

[21] Appl. No.: 173,019

[22] Filed: Jul. 28, 1980

[51] Int. Cl.[3] ..... B65H 39/06

[52] U.S. Cl. ..... 270/58; 270/21.1; 271/184

[58] Field of Search ..... 270/58, 21.1, 52.5; 493/2, 11, 344, 352, 378, 379, 420, 350, 351, 383-385; 271/184, 225, 314

[56] References Cited

U.S. PATENT DOCUMENTS

| | | | |
|---|---|---|---|
| 4,157,175 | 6/1979 | Patterson | 270/52.5 |
| 4,269,401 | 5/1981 | Sargis | 270/58 |
| 4,273,319 | 6/1981 | Stocker | 270/58 |

*Primary Examiner*—A. J. Heinz

*Attorney, Agent, or Firm*—Warren F. B. Lindsley

[57] ABSTRACT

An apparatus for cutting and collating cards or tickets arranged on paper stock in a specific sequential printed side-by-side order by moving a common one of each pair of cards or tickets laterally of their path of movement along a camming surface, which camming surface places the moving card or ticket of each pair behind the other card or ticket of that pair of tickets all in a proper sequential arrangement.

23 Claims, 14 Drawing Figures

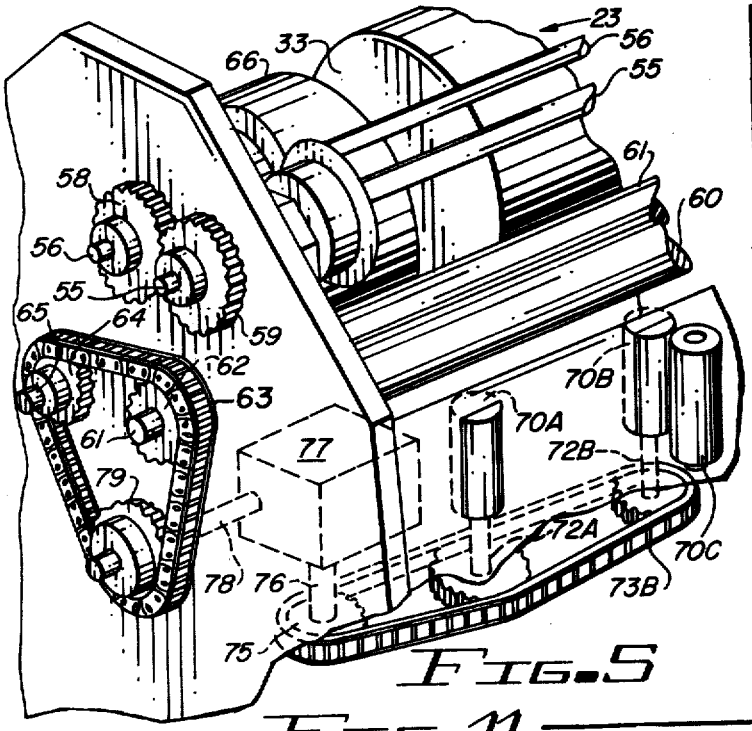
FIG. 5
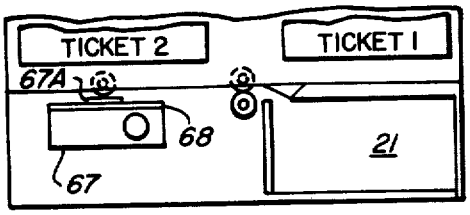
FIG. 12A
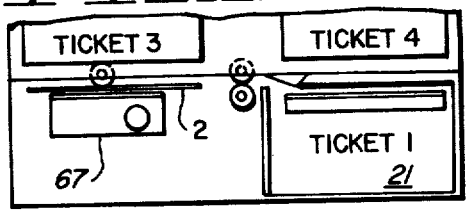
FIG. 12B
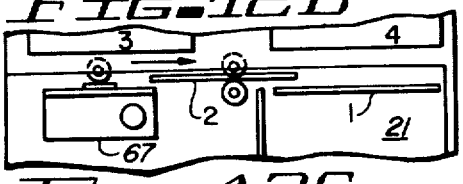
FIG. 12C
FIG. 11
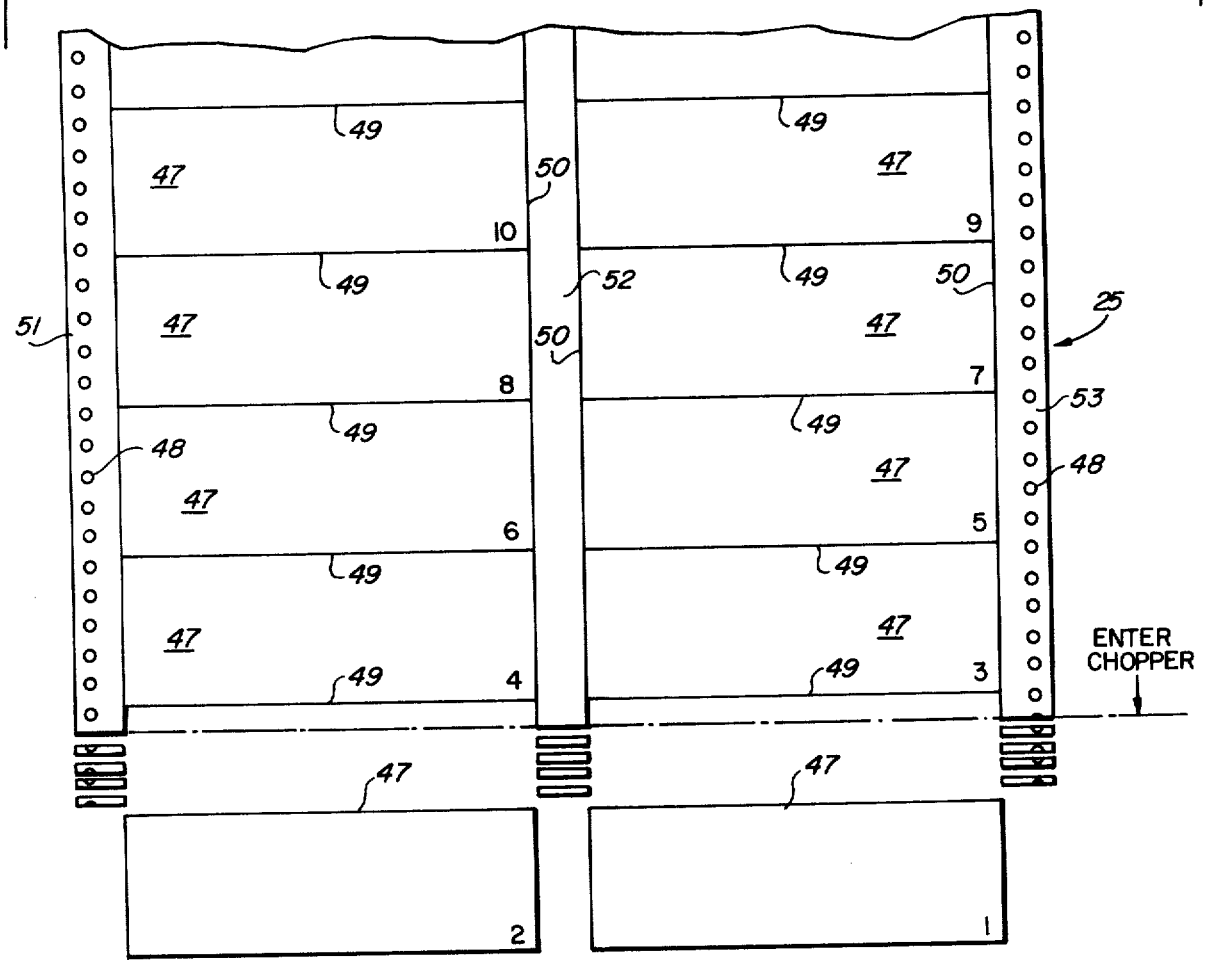

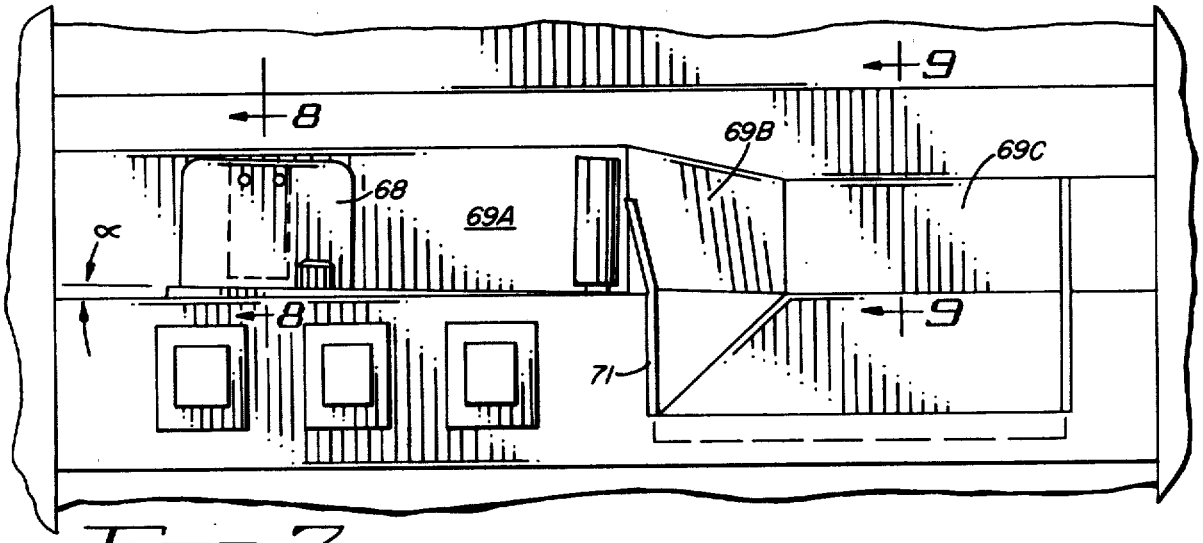
FIG. 7
FIG. 8
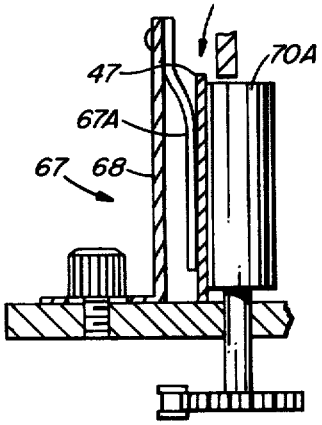
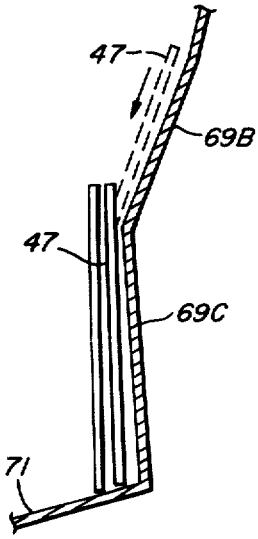
FIG. 9
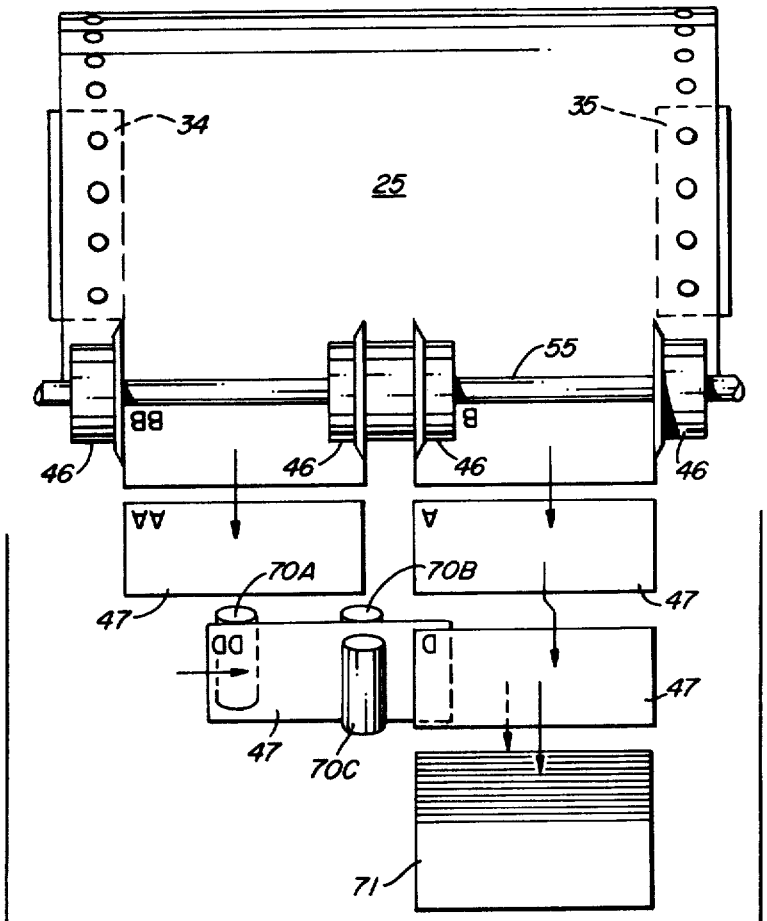
FIG. 10

CUTTING AND COLLATING METHOD AND APPARATUS FOR TICKETS

BACKGROUND OF THE INVENTION

This invention relates to apparatus for cutting and collating cards or tickets arranged in printed side-by-side columns. More particularly, this invention relates to cutting and collating tickets that are printed two abreast on paper stock specifically sequenced in a given order. When collated, all tickets will have smooth edges and stacked with printed side up and in a predetermined sequential order.

DESCRIPTION OF THE PRIOR ART

At the present time, collators have been provided for dispensing single sheets or articles from an evenly arranged stack of such objects. Cam means carefully disengage the lowermost sheet or article in the stack to provide a smooth transfer of the load from the stack supporting means to a conveyor.

U.S. Pat. No. 3,640,426 discloses a collating feeder for sequentially dispensing individual sets of sheets from a stack of crisscrossed sets. The stack is supported by two alternatively operative escapement means that oscillate into engagement with alternate sets to dispense the sets sequentially.

SUMMARY OF THE INVENTION

In accordance with the invention claimed, a new and improved collator is provided for cutting and collating tickets that are printed two abreast on paper stock such that tickets on one side of the stock are specifically sequenced with tickets on another side of the stock in column configurations.

It is, therefore, one object of this invention to provide a new and improved collator for tickets.

Another object of this invention is to provide a new and improved cutter and collator for tickets.

A further object of this invention is to provide a new and improved cutter and collator for tickets which slices the unused strips of paper stock into small pieces.

A still further object of this invention is to provide a new and improved cutting and collating apparatus for sprocketed fan folded paper stock printed to display side-by-side tickets numbered in a given sequence.

A still further object of this invention is to provide a new and improved cutter and collator for fan folded paper stock for tickets which is completely mechanically operable.

Further objects and advantages of the invention will become apparent as the following description proceeds and the features of novelty which characterize this invention will be pointed out with particularity in the claims annexed to and forming part of this specification.

BRIEF DESCRIPTION OF THE DRAWINGS

The present invention may be more readily described by reference to the accompanying drawings in which:

FIG. 5 is a partial perspective view of the left side gear drive and ticket collating mechanism of the apparatus shown in FIG. 1;

FIG. 7 is an enlarged front view of the ticket-collating mechanism shown in FIGS. 1 and 5;

FIG. 8 is a cross-sectional view of FIG. 7 taken along the line 8—8 in the direction of the arrows;

FIG. 9 is a cross-sectional view of FIG. 7 taken along the line 9—9 in the direction of the arrows;

FIG. 10 is a diagrammatical illustration of the ticket stock moving through the cutters of the apparatus and then collated into a numerically sequenced stack of tickets;

FIG. 11 is a diagrammatic view of the sprocket actuated fan folded partially cut ticket stock used in the apparatus of FIG. 1 and showing their inverted entry into the apparatus of FIG. 1; and FIGS. 12A, 12B and 12C illustrate by top views the sequence of steps of ticket movement during a collating operation.

DESCRIPTION OF THE PREFERRED EMBODIMENT

Figure 1:
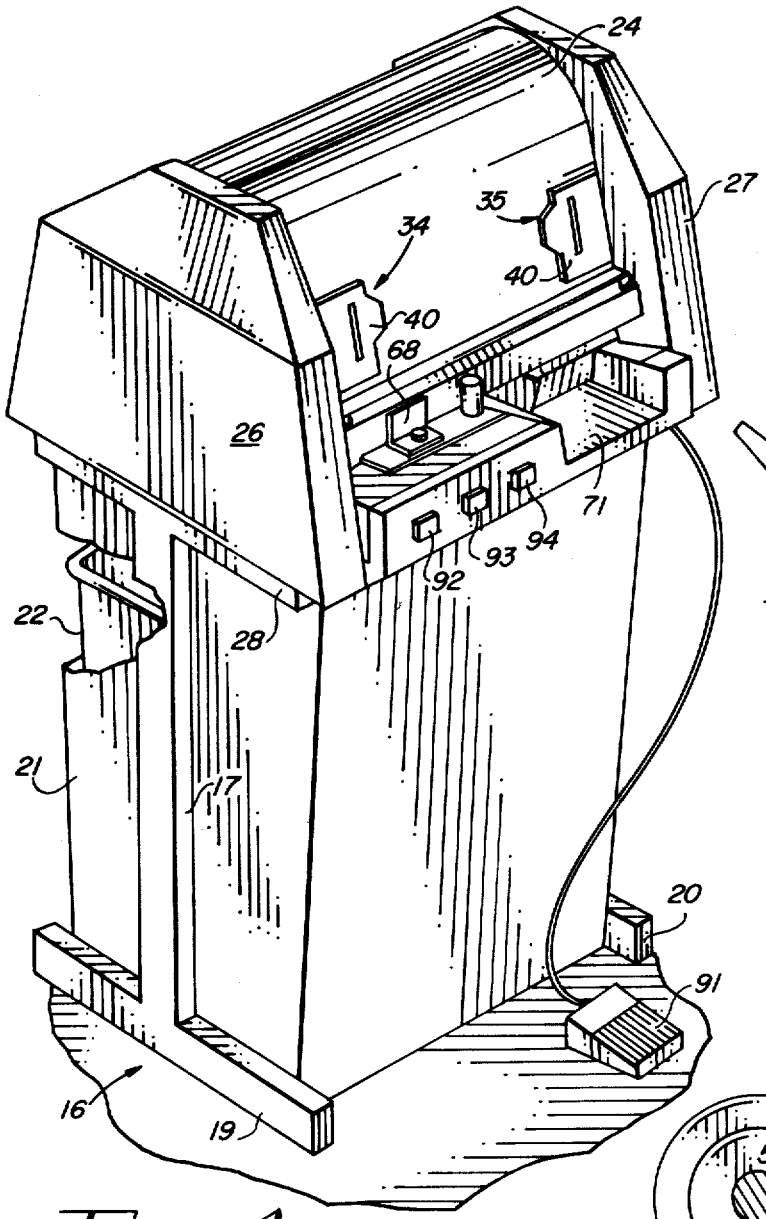
FIG. 1 is a perspective view of a cutter and collator apparatus for fan folded paper stock and embodying the invention.
Figure 2:
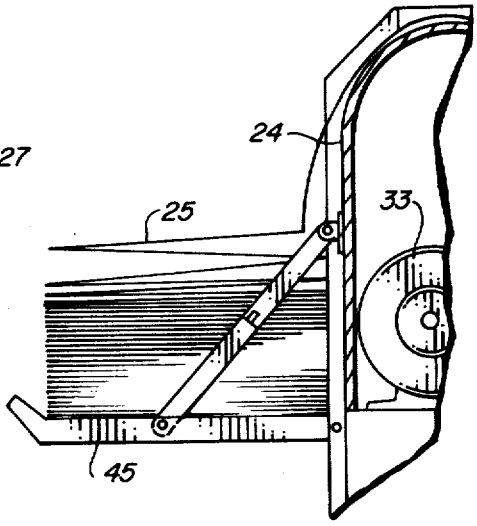
FIG. 2 is a partial cross-sectional view of the paper loading shelf mounted at the rear of the apparatus shown in FIG. 1 which when closed also serves as a guide or door for bulk feed paper stock.

Referring more particularly to the drawings by characters of reference, FIGS. 1 and 2 illustrate a ticket cutting and collating apparatus 15 comprising a supporting structure or frame 16 employing a pair of spaced apart parallel rails 17 (only one of which is shown in FIG. 1) supported by a pair of transverse legs 19 and 20. The lower part of the frame 16 encases a hollow skirt 21 open at the back to receive a bin 22 for receiving and collecting the scrap paper from the printed ticket stock after it is sliced as hereinafter explained.

Figure 3:
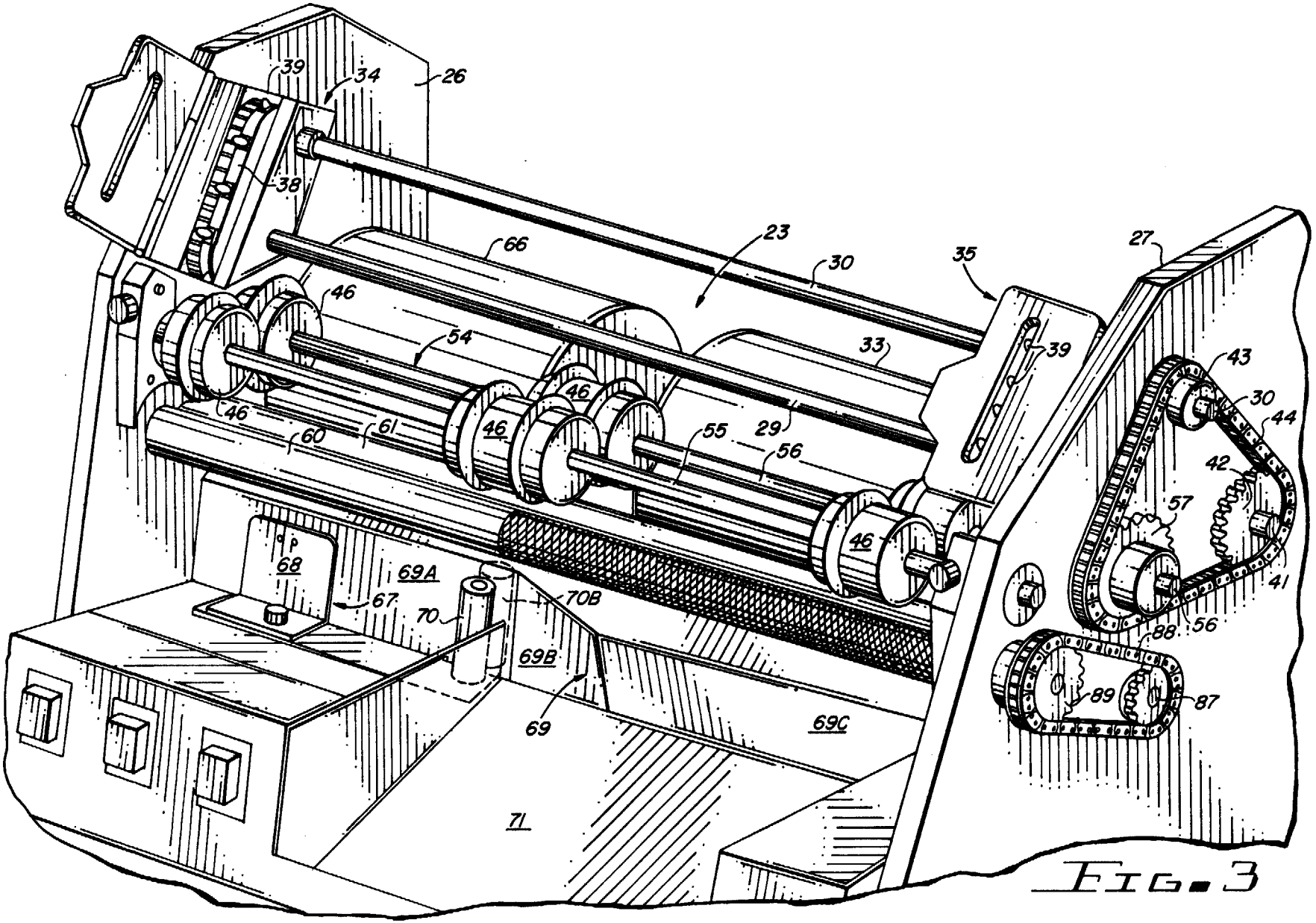
FIG. 3 is a partial perspective view of a ticket cutting head, sprocket drive mechanism and collator portion of the apparatus shown in FIG. 1 with the cover removed.

The working head 23 shown particularly in FIGS. 3 and 5 of apparatus 10 is shielded by cover 24 which serves on its outer surface as a track for receiving and guiding a stack of sprocketed fan folded paper stock 25. The working head 23 is assembled between a pair of spaced frame members 26 and 27 mounted on a pair of cross members 28 (only one of which is shown in FIG. 1) affixed to the top of rails 17.

Figure 4:
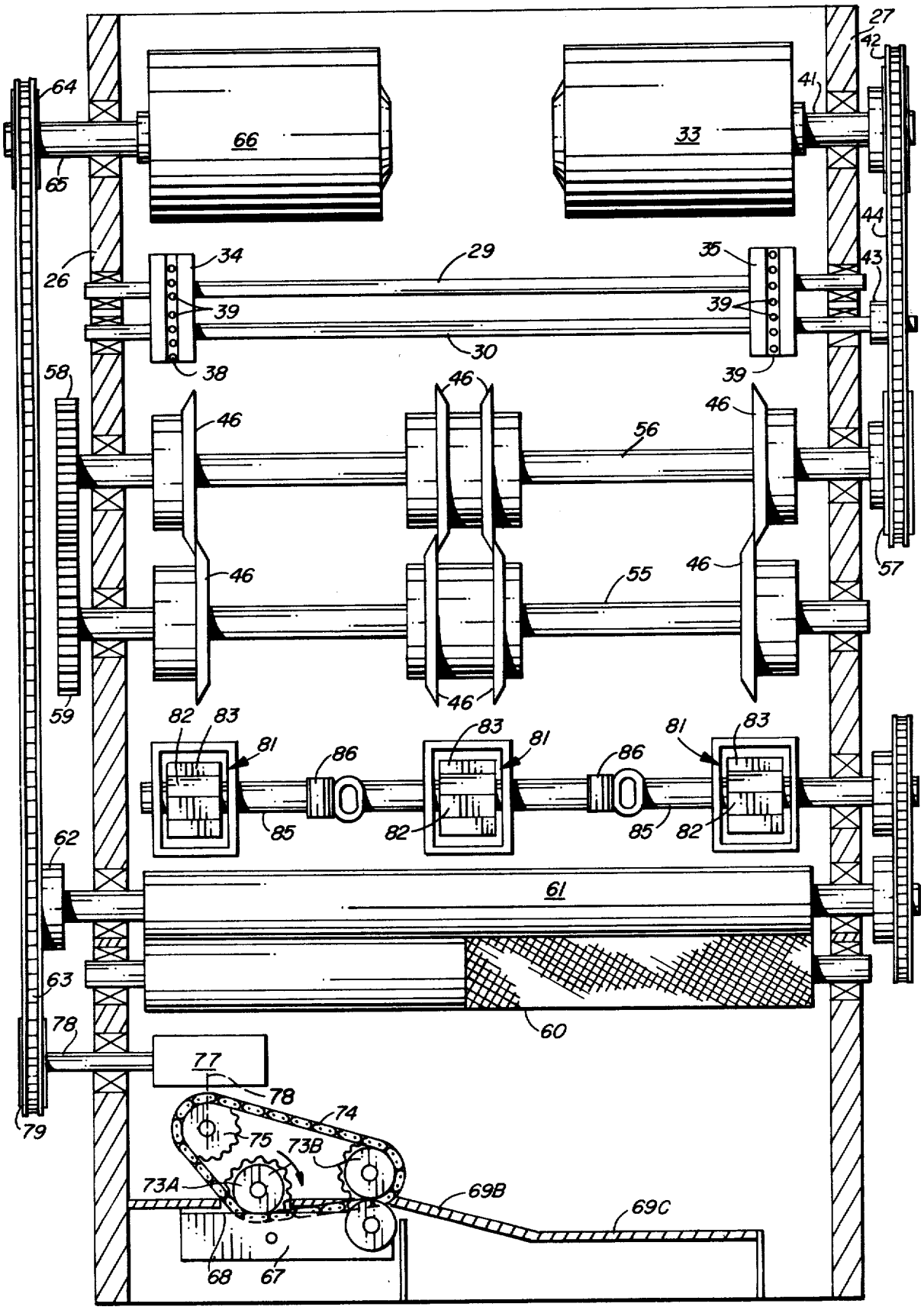
FIG. 4 is a diagrammatic illustration of the component parts of the apparatus shown in FIG. 1.

As best seen in FIGS. 3 and 4, the frame members 26 and 27 have mounted between them in a spaced horizontal arrangement a pair of drive shafts 29 and 30 the ends of which are journalled in frame members 26 and 27.

These shafts are interconnected by a pair of driving or feeding devices such as tractors 34 and 35 each formed by drive wheels 36 and 37 over which a tightly positioned belt 38 is arranged. Belt 38 of each tractor is provided with sprocket teeth 39 extending laterally from its outer surface as clearly shown in FIG. 6. The tractors 34 and 35 further each comprise a slotted plate 40 which is spring biased to lie over the sprocket teeth so as to hold the paper stock 25 against the track of cover 24 with its sprocket holes in drive contact with teeth 39 of belt 38 in the usual known manner.

As shown in FIGS. 3 and 4, shaft 30 is driven by motor 33 through its drive shaft 41 and sprockets 42 and 43 mounted on the right end of shaft 30 as shown in FIG. 3 by a belt or chain drive 44. Thus, the free end of the paper stock 25 mounted on shelf 45 at the back of apparatus 10 may be fed over cover 24 and between the plates 40 of the tractors 34 and 35 and the top surface of cover 24 with the apertures arranged along the edge of the paper stock in driving contact with the teeth of the drive chain or belt 38 to the plurality of pairs of spaced cutter wheels 46.

It should be noted that the paper stock 25 comprises an elongated fan folded arrangement of a plurality of preprinted tickets 47 that are printed two abreast on the prefolded stock of paper having sprocket holes 48 along each of its edges in a predetermined spaced arrangement. The tickets are numbered such that odd numbered tickets are on one side, for example, the right side as shown in FIGS. 10 and 11 and the even numbers on the other edge.

This paper stock is further precut along the horizontal edges 49 of the tickets so all that is needed to separate the tickets is to cut the stock vertically along the edges 50 of the tickets. It should be noted that the complete horizontal or longitudinal edges of the tickets have been precut with apparatus 10 cutting the complete lateral or vertical edges of the tickets in the strip of paper stock 25. The cutting of the lateral edges 50 of the tickets 47 results in the creation of the longitudinal strip 51 at the left side of the paper stock 25, as shown in FIG. 11, the longitudinal strip 52 arranged along the center or longitudinal axis of the paper stock 25 and the longitudinal strip 53 arranged along the right side of the paper stock. As later explained, these strips of paper stock are sliced by cutting them laterally of their longitudinal lengths with the pieces dropped into bin 22.

The ticket cutter assembly 54 of the apparatus, as shown in FIGS. 3, 4 and 5, comprises a pair of shafts 55 and 56 parallely positioned in side-by-side arrangement with their ends journaled in frame members 26 and 27. Shaft 56 is provided with a sprocket 57 at its right end, as shown in FIGS. 3 and 4, which is in toothed engagement with chain drive 44 for rotation thereof. On the left ends of shafts 55 and 56 extending outside of the walls of frame members 26 and 27 are mounted a pair of meshing gears 58 and 59 so that upon rotation of shaft 56 by chain drive 44 shaft 55 will rotate in unison therewith but in an opposite direction thereto.

A plurality of cutter wheels 46 are spacedly positioned along shafts 55 and 56 and operate in pairs, one on each of the shafts to cut or sever the tickets 47 from the paper stock 25 along the lines or edges 50 of the paper stock as heretofore explained. The paper stock 25 is fed from the rear of the apparatus between the associated pairs of cutter wheels 46 by the tractors 34 and 35 to cause the tickets to be severed from the paper stock 25.

Figure 6:
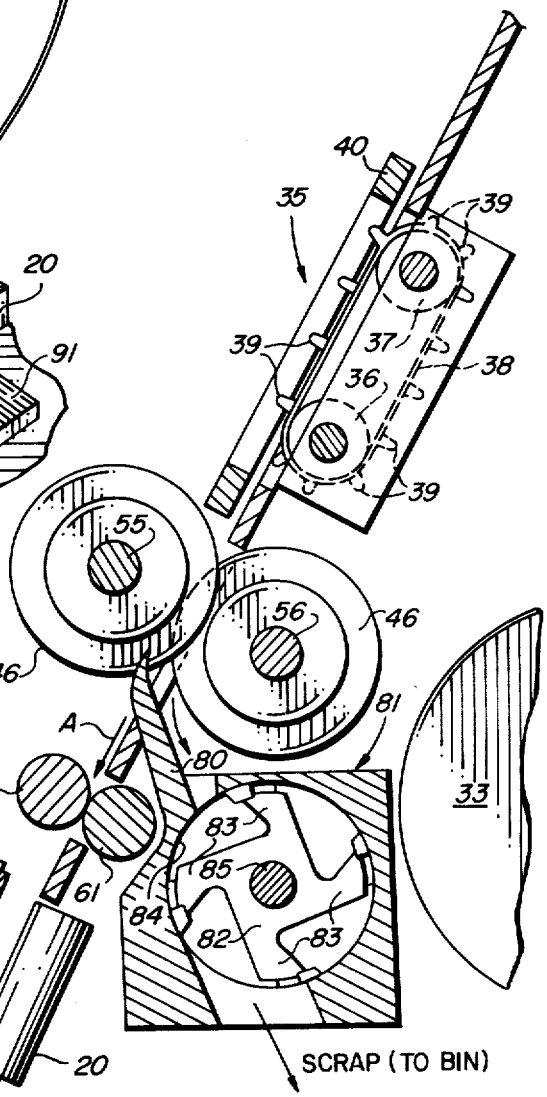
FIG. 6 is a cross-sectional view of the paper cutting and slicing mechanism of the apparatus shown in FIG. 1.
Figure 6:
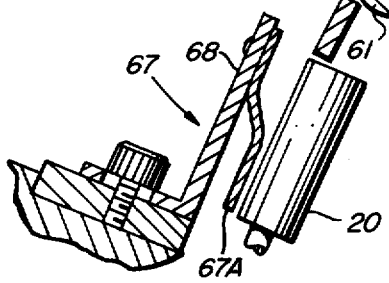

After tickets 47 are severed from the paper stock 25, they are guided by their movement in the direction of arrow A shown in FIG. 6 between a pair of accelerating rollers 60 and 61 the ends of which are journaled in frame members 26 and 27 juxtapositioned to and in parallel arrangement with shafts 55 and 56. Shaft 61 is provided with a sprocket 62 at its left end, as shown in FIGS. 4 and 5, which is in driving contact with a chain belt 63 driven by a drive sprocket 64 mounted on the end of a drive shaft 65 of a motor 66. As noted from FIGS. 4 and 5 of the drawings, a pair of cutter wheels cooperate in the manner of a pair of blades of a scissor to cut the paper moving between their cooperating cutting edges in a well known manner.

In accordance with the invention claimed, the tickets 47, after separation from paper stock 25, are collated in a proper sequence. This collating mechanism comprises, among other things, a temporary holding means such as right angular plate 67 with its spring biasing leg 67A which holds the left most tickets severed from the paper stock as viewed in FIG. 8 against driving roller 70A. Each ticket 47 received back of leg 68 of the holding plate 67 and roller 70A is actuated by roller 70A and drive and guide rollers 70B and 70C, respectively, and over a camming surface 69 comprising portions 69A, 69B and 69C. Camming surface portions 69B and 69C are offset from the plane of camming surface portion 69A. In a given timed sequence, the left most ticket 47, for example, ticket No. 2, is moved laterally toward ticket No. 1 out and over the ramp formed by camming surface portion 69B and the camming surface portion 69C to a position behind ticket No. 1. Ticket No. 1 moves directly over the camming surface portion 69C, sometimes called a mixer plate, which is spaced in front of the plane of camming surface portion 69A, as shown in FIGS. 1, 7 and 10. Thus, before ticket No. 2 reaches a spot behind ticket No. 1, ticket No. 1 has moved forwardly of ticket No. 2 by means of the shape of the camming surface 69C and longitudinally along the tray or trough 71. All of the even numbered tickets move back of the preceding odd numbered ticket in a perfect numerical order in the same manner as described relative to tickets Nos. 1 and 2.

In order for tickets in a proper sequence to be able to reach a position behind its preceding uniquely identified ticket in a properly sequenced stacked configuration, the even numbered tickets, for example, must move laterally at a speed fast enough during the stacking operation to enable the even numbered tickets to move across the camming surfaces, i.e., portions 69A, 69B and 69C before the next odd number ticket is placed in the stacked configuration. This is accomplished by the speed of rollers 70A and 70B.

As shown in FIGS. 4 and 5, shafts 72A and 72B of rollers 70A and 70B are provided with sprockets 73A and 73B at their free ends which are driven by a chain belt 74 driven by a drive sprocket 75 fixedly attached to a shaft 76. Shaft 76 is actuated by a gear box 77 driven by a shaft 78 and sprocket 79 which is in driving contact with chain belt 63. Gear box 77, which increases the speed of rotation of rollers 70A and 70B over that of the speed of rotation of rollers 60 and 61, may be replaced by a direct drive motor of a higher R.P.M. than motor 23 and 66, if so desired. As noted, 70C is a bumper or idler roller.

As the tickets are cut and separated from the scrap strips of paper by the cutter wheels 46 along their ends in order to detach them from the paper stock, the leftover waste or scrap strips of paper 51, 52 and 53 are each distorted in their plane of travel from the direction of travel of the associated tickets 47 by an arm 80 mounted immediately below rollers 60 and 61 into a cutter or slicer 81. This slicer comprises a rotating wheel 82 having a plurality of cutting arms 83 turning at a fast rate which shears against a cooperating blade or cutting edge 84 on the base of arm 80 to cut the strip longitudinally thereof into small pieces, the length of which is equal to the dwell time of the blades in relation to the feed rate of the stock. These small pieces of paper are then dropped by gravity and the rotating forced effect of the cutting arms 83 into bin 22.

As noted from FIG. 5, three slicers 81 are mounted on a shaft 85 having flexible joints 86 which shaft is geared by sprocket 87 and chain belt 88 to a sprocket 89 mounted on the right end of shaft 90 of roller 61 for rotation thereof at high speed.

Thus, in accordance with the teachings of this invention, a structure for and method of collating cards or tickets from a partially precut and preprinted paper stock is provided, with the cards and tickets arranged in a predetermined manner. In order to have these articles stacked in a proper sequence, the paper stock must be fed into the ticket cutters and collators face up and in an inverted manner over the cover 24 of the apparatus as heretofore described. In this instance, the first juxtapositioned side-by-side arrangement of printed tickets previously cut along their longitudinal edges are severed by the cutter wheels 46 with the left hand ticket moving between the spring biased leg 67A of holding plate 67 and roller 70A. Leg 67A holds the ticket in frictional contact with drive roller 70A which moves it at an accelerated rate between rollers 70B and 70C across the camming surface portion 69A, 69B and 69C behind the associated adjacent preceding specifically identified ticket in a stack configuration. This action and the sequential stacking arrangement of the tickets in the stack occurs for all the tickets printed on the paper stock 25 in the manner illustrated diagrammatically by FIGS. 8 and 9.

FIGS. 1 and 3 illustrate that apparatus 10 is electrically operated and may be controlled by hand controls or a foot pedal 91, if so desired.

The electrical system may comprise a plurality of switches 92, 93 and 94 diagrammatically shown in FIG. 1 wherein switch 92 may selectively energize the circuits, switch 93 may energize the paper feed motors 33 and 66 while switch 94 may stop or interrupt the power to the apparatus. The foot pedal may actuate the paper feed motor switch for on-off operation of the apparatus.

It should be noted that although the paper stock has been defined as having cards or tickets printed thereon in a numerical order, any specific sequential order of any type may be used in place of numerals and fall within the scope of this invention. Further, the paper stock may be any strip form of material, friction or sprocket driven, through the cutter heads of the apparaus. If sprocket driven, one or more rows of sprocket holes may be formed in the paper stock for moving the paper stack through the apparatus.

Although but one embodiment of the present invention has been illustrated and described, it will be apparent to those skilled in the art that various changes and modifications may be made therein without departing from the spirit of the invention or from the scope of the appended claims.

What is claimed is:

1. Apparatus for cutting parts from a preprinted strip of paper stock and collating the parts in a specific sequential order comprising:

a track for guiding the strip of paper stock preprinted with a sequence of pairs of specifically identified parts arranged two abreast along a given path, means for moving the strip along said path at a given speed, cutter means for simultaneously separating each pair of the parts from the strip when the strip reaches a given area on said track, a camming surface for receiving the separated two abreast parts of each pair of the two abreast parts, a collecting means for receiving the parts, and means for sequentially moving a common one of each pair of the separated two abreast parts laterally of said path along said camming surface in a substantially vertical orientation to said collecting means, said camming surface guiding the other part of each pair of said two abreast parts downstream of the laterally displaced one of the parts of each pair to said collecting means in a properly sequenced stacked configuration.

2. The apparatus set forth in claim 1 wherein:

said means for moving the strip of paper stock comprises a sprocket means having teeth which engage the paper stock for movement thereof.

3. Apparatus for cutting tickets from a sprocket fed strip of paper stock and collating the tickets in specific sequential order comprising:

a track for guiging the strip of paper stock preprinted with a sequence of pairs of specifically identified tickets arranged two abreast along a given path, sprocket means having teeth which engage the paper stock for moving the strip of paper stock along said path at a given speed, cutter means for simultaneously separating each pair of the tickets from the strip of paper stock when the strip of paper stock reaches a given area on said track, a camming surface for receiving the separated two abreast tickets of each pair, said camming surface comprising a pair of substantially parallel surfaces, one displaced laterally thereof and interconnected by a ramp, a collecting means for receiving the tickets, and means for sequentially moving a common one of each pair of the separated two abreast tickets laterally of said path along said camming surface in a substantially vertical orientation to said collecting means, said camming surface guiding the other ticket of each pair of said two abreast tickets downstream of the laterally displaced one of said tickets of each pair to said collecting means in a properly sequenced stacked configuration.

4. The apparatus set forth in claim 3 wherein:

said camming surface comprises a pair of flat surfaces one spaced downstream of the other in the direction of movement of the tickets into said collecting means.

5. The apparatus as set forth in claim 3 wherein:

said means for sequentially moving a common one of each pair of the two abreast tickets accelerates said common one of each pair to a speed greater than said speed of movement of the other ticket of said pair.

6. The apparatus set forth in claim 5 wherein:

said sprocket means and said cutter means operate at a predetermined speed.

7. The apparatus set forth in claim 6 wherein:

said sprocket means and said cutter means operate at a speed less than the speed of movement of said other ticket of each of said pair of tickets.

8. The apparatus set forth in claim 3 in further combination with:

means for accelerating the movement of each separated ticket of each pair enroute to said camming surface.

9. The apparatus set forth in claim 8 wherein:

said means simultaneously accelerates the movement of each separated ticket of each pair.

10. The apparatus set forth in claim 3 in further combination with:

slicing means mounted downstream of said cutter means for slicing the strip of paper stock remaining after the tickets have been removed therefrom.

11. The apparatus set forth in claim 10 wherein:

said slicing means comprises arm means for distorting the direction of travel of the strip of paper stock after the tickets have been removed therefrom laterally away from the separated tickets.

12. The apparatus set forth in claim 10 wherein:

said cutter means comprises a plurality of pairs of spacedly arranged cooperating rotating cutter blades, and said slicing means comprises a plurality of spacedly arranged rotating blade means one arranged downstream of each of said pairs of cutter blades for receiving a portion of the remainder of the strip of paper stock.

13. The apparatus set forth in claim 3 in further combination with:

a strip of paper stock preprinted with a sequence of pairs of specifically identified tickets arranged two abreast, said strip of paper stock having a plurality of sprocket holes arranged longitudinally thereof along each of its edges.

14. The apparatus set forth in claim 13 wherein:

said strip of paper stock is folded at a plurality of lines along its length to form a stack for feeding into said apparatus.

15. The apparatus set forth in claim 13 wherein:

the printed side of said paper stock is inverted and fed to said track.

16. A method of cutting tickets from a strip of paper stock and collating the tickets in a specific order comprising the steps of:

feeding a strip of preprinted ticket paper stock having pairs of tickets printed in two abreast arrangements laterally across the strip through a cutting means, feeding the separated two abreast pairs of tickets to a camming surface, sequentially moving a common one of each pair of said two abreast tickets laterally along said camming surface in a substantially vertical orientation to a collecting means, guiding the other of each pair of said two abreast tickets over said camming surface downstream of the laterally displaced one of said tickets of each pair to said collecting means in a specific stacked configuration.

17. The method set forth in claim 16 wherein:

said strip of preprinted ticket paper stock is sprocket driven through said cutting means.

18. The method set forth in claim 16 wherein:

said common one of each pair of said two abreast tickets are moved along said camming surface at a speed sufficient to place it in a predetermined sequence with the associated other ticket of said pair in said stacked configuration.

19. The method set forth in claim 16 wherein:

the separated two abreast pairs of tickets are fed to said camming surface at an accelerated speed greater than their speed through said cutting means.

20. The method set forth in claim 16 wherein:

said strip of preprinted ticket paper stock is inverted and fed through said cutting means.

21. The method set forth in claim 16 wherein:

said strip of preprinted ticket paper stock comprises a member having two rows of sprocket holes, one arranged along each of the longitudinal edges of said paper stock.

22. The method set forth in claim 16 in further combination with the step of:

slicing a remainder of said strip of paper stock after the tickets have been separated therefrom.

23. The method set forth in claim 16 in further combination with the steps of:

distorting the path of movement of a remainder of the paper stock after the tickets have been removed therefrom laterally of the movement of the tickets, slicing the remainder of the strip of paper stock, and directing the sliced stock into a bin under the action of gravity and/or rotary action of the slicing device.

* * * * *